United States Patent [19]

McIrvine

[11] 4,307,958

[45] Dec. 29, 1981

[54] PRINTING MACHINE HAVING IMMEDIATE DUPLEXING CAPABILITIES

[75] Inventor: Edward C. McIrvine, Rochester, N.Y.

[73] Assignee: Xerox Corporation, Stamford, Conn.

[21] Appl. No.: 180,287

[22] Filed: Aug. 22, 1980

[51] Int. Cl.[3] ..... G03B 27/32

[52] U.S. Cl. ..... 355/23; 101/DIG. 13; 355/26

[58] Field of Search ..... 355/14 SH, 3 SH, 23, 355/24, 26; 271/65, 186, DIG. 9; 101/DIG. 13

[56] References Cited

U.S. PATENT DOCUMENTS

| | | | |
|---|---|---|---|
| 3,052,213 | 9/1962 | Schaffert | 118/637 |
| 3,913,719 | 10/1975 | Frey | 101/91 X |
| 4,136,862 | 1/1979 | Kunz et al. | 271/186 |
| 4,140,387 | 2/1979 | Gustafson | 355/14 SH |
| 4,158,500 | 6/1979 | DiFrancesco | 355/14 SH |
| 4,169,674 | 10/1979 | Russel | 355/14 SH |

*Primary Examiner*—Richard L. Moses
*Attorney, Agent, or Firm*—H. Fleischer; H. M. Brownrout

[57] ABSTRACT

A printing machine in which a sheet is moved into communication with a marking station to establish visible representations of indicia thereon. After establishing indicia on one side of the sheet, the sheet is inverted so that the same leading edge of the sheet moves into communication with the marking station. As the other side of the sheet moves into communication with the marking station, visible representations of indicia are established thereon.

18 Claims, 1 Drawing Figure

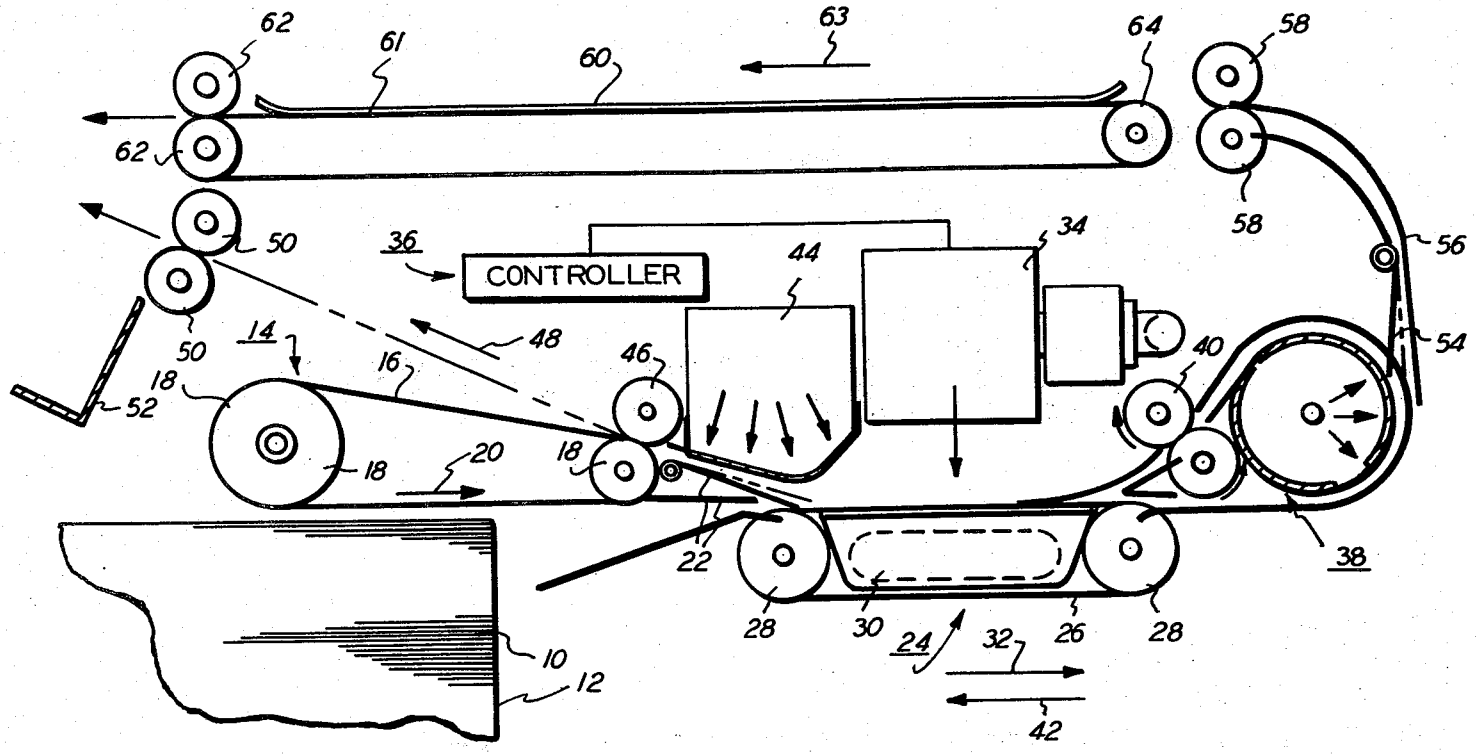
CONTROLLER

PRINTING MACHINE HAVING IMMEDIATE DUPLEXING CAPABILITIES

The present invention relates to a printing machine, and more specifically concerns a printing machine having duplexing capabilities.

In typical electrophotographic printing machines, duplex copies are made by completing the first copying process of all of the original documents on the first side, storing the copy sheets in an interim feed tray, inverting or changing the documents, and then refeeding the stored copies for a second imaging pass of the opposed side thereof. The resultant copies must be collated and sorted. This arrangement frequently requires a separate sorting device. Any subsequent finishing, i.e. stapling of the sets, must be done off line after unloading by the operator. When a recirculating document handling system is employed, copies must be recirculated and passed through the process in the same direction in order to generate duplex copies. These systems generally require an inverter, an interim stacking tray, bottom sheet feeding and/or stack lifting mechanisms, associated with transports, drive and controls. Furthermore, memory circuits dictated by the need to track the multiplicity of in-process copies resulting from a long copy return path are also necessitated. If the printing machine is a short edge feed device rather than a long edge feed device, automatic duplexing requires that the sheet be rotated as well as inverted between the first and second imaging pass. Only in this way, will a common top edge be maintained between the first and second sides of the copy sheets. This requires additional structure and process time as well as extra sensors and controls.

Various techniques have been devised for recirculating copy sheets to facilitate duplex copying. The following art appears to be relevant:

U.S. Pat. No. 3,052,213
Patentee: Schaffert
Issued: Sept. 4, 1962
U.S. Pat. No. 3,913,719
Patentee: Frey
Issued: Oct. 21, 1975
U.S. Pat. No. 4,140,387
Patentee: Gustafson
Issued: Feb. 20, 1979
U.S. Pat. No. 4,158,500
Patentee: DiFrancesco et al.
Issued: June 19, 1979
U.S. Pat. No. 4,169,674
Patentee: Russel
Issued: Oct. 2, 1979

The disclosures of the pertinent portions of the foregoing patents may be briefly summarized as follows:

Schaffert discloses the formation of an electrostatic image on a print element. A plurality of electrodes are arranged in a row across the path of travel of the print element. The electrodes are electrically biased and supplied with ink. The spray of ink from the electrodes is under the control of the electrostatic image on the print element to completely develop the image.

Frey describes a printing system in which a computer controlled ink jet printer prints a portion of a newspaper page.

In FIGS. 5 through 7, inclusive, Gustafson discloses a copy sheet feeding section for presenting both sides of the copy sheets to have visible representations formed thereon. Copy sheets are advanced from a stack to a photoconductor to have a toner powder image transferred from the photoconductor to the sheet. The copy sheet then moves through an inverter to a fuser. After fusing, the sheet is reversed in its direction of movement back to the photoconductor. At the photoconductor, another toner powder image is transferred to the other side of the sheet. The copy sheet then passes through the fuser to an exit tray.

DiFrancesco et al., in FIG. 5, describes a copy duplexing section including a supply hopper for receiving a stack of copy sheets. These sheets are fed from the hopper to a first transfer station for transferring marking particles from a photoconductor to one side of the copy sheet. A sheet inverter draws the sheet from the photoconductor, and returns the sheet thereto with the opposite face thereof in contact therewith. A second transfer station transfers another image to the side of the copy sheet engaging the photoconductor.

Russel discloses a recirculating document feeder in which sheets are stacked right side up in their normal sequential order. These sheets are removed, one at a time, from the bottom of the stack, presented face down for copying, and returned right side up to the top of the stack.

In accordance with the features of the present invention, there is provided a printing machine including means for establishing visible representations of indicia on a sheet. Means, defining a duplex path, move one side of the sheet into communication with the establishing means. The moving means inverts the sheet to move the other side thereof into communication with the establishing means. Moving means moves the same leading edge of the sheet initially into communication with the establishing means before and after inverting the sheet. Means, operatively associated with the establishing means, control the establishing means to correct for inverting the sheet so as to form properly oriented visible indicia on both side of the sheet.

Other features of the present invention will become apparent as the following description proceeds and upon reference to the drawing depicting a schematic elevational view of the printing machine of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the printing machine of the present invention, reference is made to the drawing. In the drawing, like reference numerals have been used throughout to designate identical elements. The drawing depicts a printing machine incorporating the features of the present invention therein. Inasmuch as the art of printing is well known, the various processing stations employed in the printing machine will be shown hereinafter schematically and their operation described with reference thereto.

Referring now to the drawing, a stack of sheets of support material 10 are stored in a tray 12. A sheet feeding device, indicated generally by the reference numeral 14, advances successive sheets in seriatim, from stack 10. Preferably, sheet feeding apparatus 14 includes an endless belt 16 entrained about a pair of spaced rollers 18. Belt 16 engages the uppermost sheet of stack 10 so as to advance it therefrom in the direction of arrow 20. A motor (not shown) is coupled to one of the rollers 18 to drive belt 16 in the direction of arrow 20. As the uppermost sheet of stack 10 is transported in the direction of arrow 20, a one-way gate 22 couples belt 16 with a sheet transport, indicated generally by the reference numeral 24.

Sheet transport 24 includes a belt 26 having a plurality of apertures therein entrained about a pair of spaced rollers 28. A housing 30 is positioned interiorally of belt 10. Housing 30 includes a plenum in contact with the undersurface of belt 26. A blower is disposed interiorally of housing 30 and arranged to produce a flow of air inwardly through the apertures in belt 26 so as to cause the advancing sheet to adhere to belt 26. At this time, a motor (not shown) is coupled to one of the drive rollers and moves belt 26, at a substantially constant linear velocity, in the direction of arrow 32. For illustrative purposes, it has been assumed that the sheet of support material is advanced with the short edge being fed. As the leading edge of the sheet passes beneath a matrix printer, indicated generally by the reference numeral 34, which is preferably an ink jet printhead, liquid ink is deposited on the sheet of support material in a first decision, i.e. so that the indicia recorded thereon produce successive lines of information reading from left to right. Output signals from a control unit, indicated generally by the reference numeral 36, regulate printer 34 so as to produce the desired indicia on the copy sheet. Ink jet printer head 34 is connected to an ink supply, a power supply, and a path of input information to modulate the power supply. For example, the power supply may provide a DC voltage for generation of a drop deflecting electrostatic field and a regulated AC voltage for drop formation. However, any suitable type of ink jet printing head may be employed, i.e. either a moving head array or a multiple-head array. For example, printing head 34 may be constructed generally as described in U.S. Pat. No. 3,701,998 issued to Mathis with the rows of orifices staggered for full printing coverage as described in U.S. Pat. No. 3,560,641 issued to Taylor.

Controller 36 preferably includes a memory unit which stores sufficient data to regulate the printing of at least a complete side of a copy sheet. Initiation of output from the memory unit is under the control of logic circuitry. The logic circuitry is actuated after a prescribed number of timing pulses having been counted. In this way, the memory unit of controller 36 is unloaded to regulate the print head through the appropriate logic circuitry. The memory unit is designed to control the printing head so that the first side of the sheet of support material has information produced thereon reading from left to right. Similarly, the memory unit is arranged to control the printing head so as to write in the opposite direction on the other side of the sheet. In this way, the information on the other side of the sheet will also read from left to right. The information stored by the memory unit may be furnished thereto by scanning the original document or from storage elements, i.e. tapes, discs, etc.

After all of the information has been deposited on the first side of the sheet of support material as liquid marking material, transport 24 advances the sheet about a turn-around device 38 which is cylindrical. Cylinder 38 includes a heating element positioned interiorly thereof to dry the liquid ink on the first side of the sheet of support material as it passes thereover. Guide rollers 40 continue to advance the sheet of support material back onto transport 24 which is now actuated to move in the direction of arrow 42. As the other side of the sheet of support material advances under ink jet printing head 34, information is recorded thereon also reading from left to right. In this latter mode of operation, the printing head operates in a line reversal mode, i.e. in the opposite direction to that previously operated for recording the information on the first side of the sheet of support material. After the information has been recorded on the other side of the copy sheets, it passes beneath dryer 44, which is a radiant heating device. At this time, gate 22 is positioned to guide the advancing sheet of support material to move between roller 18 and roller 46. The sheet moves in the direction of arrow 48. Forwarding rollers 50 advance the sheet of support material with the information permanently affixed thereto to output tray 52. The sheets of support material stored in tray 52 may be readily removed therefrom by the machine operator.

In the simplex mode of printing, after dryer 38 heats one side of the copy sheet to permanently affix the liquid material thereto, gate 54 directs the advancing sheet into chute 56 which guides the sheet between rollers 58. Rollers 58 move the sheet onto transport 60 which advances the sheet in the direction of arrow 63 to forwarding roller 62. Transport 60 includes a belt 61 entrained about the lowermost roller 62 and roller 64. Rollers 62 and 64 are spaced from one another. Belt 61 moves the sheet in the direction of arrow 63. As the sheet passes between rollers 62, it is advanced to output tray 52 for subsequent removal therefrom by the machine operator.

In recapitulation, the printing machine of the present invention operates in either a duplexing or simplexing mode. During duplex copying, the two sides of the sheet are advanced sequentially beneath an ink jet printing head so that the information may be deposited thereon. A common leading edge initially moves beneath the ink jet head. A controller regulates the ink jet printing head so as to insure that the indicia recorded on each side of the copy sheet reads from left to right. In order to achieve the foregoing, the ink jet printing head has line reversal between one side of the sheet of support material and the other side thereof. A system of this type has a 180° return path for duplexing. In this way, only one tray is required for storing the sheets of support material. An interim tray for simplex storage is not required. Furthermore, collated simplex or duplex sheets are stored in a single output tray without the requirement of an inverter. This compact sheet path facilitates smaller machine sizes. Furthermore, a simple single sheet feeder is required rather than two sheet feeders being needed, i.e. when a duplex storage tray is provided. Furthermore, a common lead edge is always advanced to the printing machine irrespective of the side of the sheet having the information deposited thereon. A system of this type is relatively simple with little or no complexity associated with the duplex printing function, thereby significantly reducing the cost of the printing machine.

It is, therefore, evident that there has been provided in accordance with the present invention a printing machine that fully satisfies the aims and advantages hereinbefore set forth. While this invention has been described in conjunction with a preferred embodiment thereof, it will be evident that many alternatives, modification and variations will be apparent to those skilled in the art. Accordingly, it is intended to embrace all such alternatives, modification and variations that fall within the spirit and broad scope of the appended claims.

What is claimed is:

1. A printing machine, including:

means for establishing visible representations of indicia on a sheet;

means, defining a duplex path, for moving one side of the sheet into communication with said establishing means and inverting the sheet to move the other side of the sheet into communication with said establishing means, said moving means moving the same leading edge of the sheet initially into communication with said establishing means before and after inverting the sheet; and means, operatively associated with said establishing means, for controlling said establishing means to correct for inverting the sheet so as to form properly oriented visible indicia on both sides of the sheet.

2. A printing machine according to claim 1, further including:

means for supporting a stack of sheets; and means for advancing, in seriatim, successive sheets from the stack to said moving means.

3. A printing machine according to claim 2, wherein said establishing means includes:

means for placing marking material on the sheet to establish visible representations of the indicia thereon; and means for fixing substantially permanently the marking material to the sheet.

4. A printing machine according to claim 3, wherein said control means regulates said placing means to place marking material on one side of the sheet in a first direction and on the other side of the sheet in a second direction opposed to the first direction with each line of indicia on both sides of the sheet being substantially normal to the direction of movement of the sheet.

5. A printing machine according to claims 3 or 4, wherein said placing means includes means for depositing a liquid marking material on the sheet.

6. A printing machine according to claim 5, wherein said fixing means includes:

first means for heating one side of the sheet to permanently fix the liquid marking material to the sheet; and second means for heating the other side of the sheet to permanently fix the liquid marking material to the sheet.

7. A printing machine according to claim 6, wherein said moving means advances the sheet at a substantially constant linear velocity.

8. A printing machine according to claim 7, further including means for securing releasably the sheet to said moving means.

9. A printing machine according to claim 8, wherein said moving means includes a belt for supporting the sheet.

10. A method of printing, including the steps of:

moving one side of the sheet into communication with a marking station;

establishing visible representations of indicia on one side of the sheet;

inverting the sheet;

moving the other side of the sheet into communication with the marking station with the same leading edge of the sheet initially moving into communication with the marking station before and after said step of inverting;

establishing visible representations of indicia on the other side of the sheet; and controlling the marking station to correct for inverting the sheet so as to form properly oriented visible indicia on both side of the sheet.

11. A method of printing according to claim 10, further including the steps of:

supporting a stack of sheets; and feeding, in seriatim, successive sheets from the stack to a transport moving the sheets into communication with the marking station.

12. A method of printing according to claim 11, wherein said step of establishing includes the steps of:

placing marking material on the sheet to establish visible representations of the indicia thereon; and fixing substantially permanently the marking material to the sheet.

13. A method of printing according to claim 12, wherein said steps of controlling includes the step of regulating the marking station to place marking material on one side of the sheet in a first direction and on the other side of the sheet in a second direction opposed to the first direction with each line of indicia on both sides of the sheet being substantially normal to the direction of movement of the sheet.

14. A method of printing according to claims 12 or 13, wherein said step of placing includes the step of depositing a liquid marking material on the sheet.

15. A method of printing according to claim 14, wherein said step of fixing includes the steps of:

heating one side of the sheet to permanently fix the liquid marking material to the sheet; and heating the other side of the sheet to permanently fix the liquid marking material to the sheet.

16. A method of printing according to claim 15, wherein said step of moving includes the step of advancing the sheet at a substantially constant linear velocity.

17. A method of printing according to claim 16, further including the step of securing releasably the sheet to the transport moving the sheet into communication with the marking station.

18. A method of printing according to claim 17, wherein said step of moving includes the step of supporting the sheet on a belt.

* * * * *